United States Patent [19]

Ishikawa et al.

[11] Patent Number: 4,681,835

[45] Date of Patent: Jul. 21, 1987

[54] METHOD OF PROCESSING SILVER HALIDE COLOR PHOTOGRAPHIC MATERIAL CONTAINING PYRAZOLOAZOLE-TYPE MAGENTA COUPLER USING A FINAL BATH CONTAINING A SOLUBLE IRON SALT

[75] Inventors: Takatoshi Ishikawa; Kiyoshi Nakazyo, both of Kanagawa, Japan

[73] Assignee: Fuji Photo Film Co., Ltd., Kanagawa, Japan

[21] Appl. No.: 807,934

[22] Filed: Dec. 12, 1985

[30] Foreign Application Priority Data

Dec. 14, 1984 [JP] Japan ..... 59-264185

[51] Int. Cl.[4] ..... G03C 5/00; G03C 5/24; G03C 7/38

[52] U.S. Cl. ..... 430/386; 430/337; 430/372; 430/421; 430/428; 430/429; 430/490

[58] Field of Search ..... 430/386, 372, 421, 337, 430/428, 429, 490

[56] References Cited

U.S. PATENT DOCUMENTS

| | | | |
|---|---|---|---|
| 3,647,452 | 3/1972 | Hendess et al. | 430/386 |
| 4,336,324 | 6/1982 | Koboshi et al. | 430/372 |
| 4,338,393 | 7/1982 | Bailey et al. | 430/386 |
| 4,500,630 | 2/1985 | Sato et al. | 430/372 |
| 4,500,632 | 2/1985 | Ohmura et al. | 430/428 |
| 4,548,899 | 10/1985 | Nakayama et al. | 430/386 X |
| 4,576,910 | 3/1986 | Hirano et al. | 430/386 X |

FOREIGN PATENT DOCUMENTS 0071402 9/1983 European Pat. Off. .

*Primary Examiner*—John E. Kittle

*Assistant Examiner*—Mukund J. Shah

*Attorney, Agent, or Firm*—Sughrue, Mion, Zinn, Macpeak and Seas

[57] ABSTRACT

A method of processing a silver halide color photographic material, which comprises processing a photographic material containing at least one pyrazoloazole type magenta coupler represented by the general formula (I) in a final bath containing a soluble iron salt in an amount of at least $1\times10^{-4}$ mol/l, whereby marked improvements in stabilization of color images, especially cyan dye images and prevention of yellow stain are achieved:

(I)

wherein $R_1$ represents a hydrogen atom or a substituent, X represents a hydrogen atom or a group capable of being eliminated by the coupling reaction with an oxidation product of an aromatic primary amine developing agent, and $Z_a$, $Z_b$ and $Z_c$ each represents methine group, a substituted methine group, =N— or —NH—, provided that one of the $Z_a$-$Z_b$ and $Z_b$-$Z_c$ bonds is a double bond and the other is a single bond, in which when it represents a double bond the $Z_b$-$Z_c$ bond includes one which constitutes a part of an aromatic ring, and further, the substituent $R_1$ or X, or the substituted methine represented by $Z_a$, $Z_b$ or $Z_c$ may form a polymer including a dimer.

14 Claims, No Drawings

METHOD OF PROCESSING SILVER HALIDE COLOR PHOTOGRAPHIC MATERIAL CONTAINING PYRAZOLOAZOLE-TYPE MAGENTA COUPLER USING A FINAL BATH CONTAINING A SOLUBLE IRON SALT

FIELD OF THE INVENTION

The present invention relates to a method of processing a silver halide color photographic material and, more particularly, to a processing method by which remarkably high image stability can be imparted to the processed silver halide color photographic material.

BACKGROUND OF THE INVENTION

Dye images obtained by development-processing silver halide color photographic materials are generally produced from azomethine dyes or indoaniline dyes formed by the reaction of oxidation products of aromatic primary amine type developing agents with couplers. Such dye images are not always stable to light and heat. As a result, discoloration or change of color in the image areas, or increase in stain frequently happens and thus the image quality deteriorates. In particular, deterioration of cyan image and increase in yellow stain are serious problems of color photographic papers since it is usual for the photographic papers to be kept in albums or the like at private homes.

Various attempts have been made to improve image quality for the purpose of solving the above-described problems.

For instance, Japanese Patent Application (OPI) Nos. 11330/74 and 57223/75 disclose enclosing dye images by oxygen-intercepting layers made up of substances having low permeability to oxygen, and Japanese Patent Application (OPI) 85747/81 discloses providing a layer having oxygen permeability of 20 ml/m$^2$.hr.atm or less on the support side of an dye image forming layer of a color photographic material. These attempts have had some effect upon prevention of yellow stain. However, they produce no effect whatsoever on cyan dye images and, to make the matter worse, cases occur in which they accelerate deterioration of cyan dye images. Also, the method in which a surface-protecting layer is designed so as to have a multilayer structure, as described in Japanese Patent Publication No. 8346/81, fails to bring about a sufficient effect.

On the other hand, various cyan couplers have been developed for the purpose of forming stable cyan dye images. Examples of such couplers include two equivalent orthoacylaminophenol type couplers described in U.S. Pat. Nos. 3,772,002 and 3,998,642; 2,5-diacylaminophenol type couplers described in U.S. Pat. Nos. 2,772,162, 2,895,826, 3,758,308, 4,146,396, 4,362,810, 4,299,914, 4,334,011 and 4,463,086, Japanese Patent Application (OPI) No. 31954/84, and so on; and carbostyryl type couplers described in U.S. Pat. No. 4,430,423, Japanese Patent Application (OPI) Nos. 104333/81 and 134635/83, and so on. Though many of those couplers can produce cyan dyes excellent in fastness to heat, some of them have inappropriate hue and most of them suffer deterioration on fastness to light. In addition, they have no effect whatsoever upon prevention of yellow stain. Such being the case, no cyan couplers have yet developed with sufficiently high image fastness.

In addition, various discoloration inhibitors also have been developed. Examples of which include hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028, British Patent No. 1,363,921, Japanese Patent Application (OPI) No. 24141/83, and so on; gallic acid derivatives described in U.S. Pat. Nos. 3,457,079 and 3,069,262, and so on; p-alkoxyphenols described in U.S. Pat. Nos. 2,735,765, 3,689,909 and 3,764,337, and Japanese Patent Publication No. 6623/77; p-oxyphenol derivatives described in U.S. Pat. Nos. 3,432,300, 3,573,050, 3,574,627, 3,764,337 and 4,113,495, and Japanese Patent Application (OIP) Nos. 35633/77 and 147434/77; and bisphenols described in U.S. Pat. No. 3,700,455, and so on. However, these compounds are still insufficient in discoloration inhibiting effect.

On the other hand, various means for obtaining images excellent in fastness have been developed based on photographic processing. For instance, it is common knowledge that a stabilizing bath is employed as the final bath. The stabilizing bath contains generally a pH controlling agent, a surface active agent, an image-stabilizing agent like formaldehyde, a brightening agent and so on. However, it has no effect upon discoloration of cyan images, and in many cases, it can only produce a slight effect on prevention of yellow stain.

Further, U.S. Pat. No. 4,336,324 describes a multistage counter current processing including no washing step, and for the purpose of preventing photographic materials from having yellow stains due to that processing, a chelating agent has been jointly employed (see Japanese Patent Application (OPI) No. 58143/82) and a water soluble bismuth compound has been added (see Japanses Patent Application (OPI) No. 134636/83). However, the attempts are insufficient to effect the above-described purpose.

Furthermore, it is known that the processing with a stabilizing bath having a high iron salt concentration can prevent images from discoloring, as described in Japanese Patent Application (OPI) No. 14834/83. However, this processing also is insufficent in prevention of yellow stains, and it is therefore hard to say that such can ensure excellent image fastness.

As mentioned above, it was very difficult to attain stabilization of color images, particularly cyan dye image, and prevention of yellow stains simultaneously. This difficulty is thought to result from the contrariness of conditions under which images undergo deriorations, that is to say, cyan dye images are subject to deterioration in a reductive atmosphere, whereas yellow stains tend to be produced in an oxidative atmosphere.

SUMMARY OF THE INVENTION

Therefore, a first object of the present invention is to provide a method for processing a silver halide color photosensitive material which ensures marked improvements in the stabilization of images, particularly prevention against deterioration of cyan dye images, and in prevention of yellow stain.

A second object of the present invention is to provide a method for processing a silver halide color photosensitive material which enables a great saving of water to be used in a washing step.

The above-described objects are attained by processing a silver halide color photosensitive material, which contains at least one pyrazoloazole type magenta coupler represented by the following general formula (I), in a final bath containing a soluble iron salt in an amount of at least $1\times10^{-4}$ mol/l:

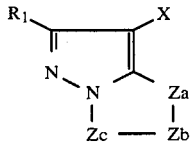

(I)

In the formula, $R_1$ represents a hydrogen atom or a substituent group, and X represents a hydrogen atom or a group capable of being eliminated upon the coupling reaction with an oxidation product of an aromatic primary amine developing agent. Za, Zb and Zc each represents a methine group, a substituted methine group, =N— or —NH—, and one of the Za-Zb and Zb-Zc bonds is a double bond and the other is a single bond. When the Zb-Zc bond is a carbon-carbon double bond, it may constitute a part of an aromatic ring. In addition, $R_1$ or X may form a polymer, including a dimer. Further, when Za, Zb or Zc represents a substituted methine group, the substituted methine may form a polymer, including a dimer.

DETAILED DESCRIPTION OF THE INVENTION

The term "polymer" used in the description of the formula (I) means a compound having two or more groups represented by the formula (I) in a molecule, and includes a bis compound and a polymeric coupler. The term "polymeric coupler" as herein used includes a homopolymer formed solely from a monomer having a moiety represented by the formula (I) (preferably, a monomer having a vinyl group, which is referred to as a vinyl monomer hereinafter) and a copolymer comprising said monomer and a non-color-forming ethylenic mononer incapable of coupling with an oxidation product of an aromatic primary amine developing agent.

Compounds represented by the general formula (I) are couplers of the two 5-membered rings condensed nitrogen-containg hetero ring type. The aromaticity manifested by their mother nuclei participating in color formation and that of naphthalene are isoelectronic, and the chemical structure of such mother nuclei is generically called azapentalene. Of the couplers represented by the general formula (I), 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles are preferred over others, and they are represented by the general formulae (II), (III), (IV), (V), (VI) and (VII), respectively. In particular, compounds represented by the general formulae (II) and (V), respectively, are used to advantage.

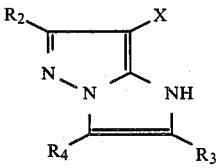

(II)

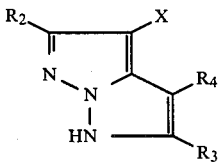

(III)

-continued

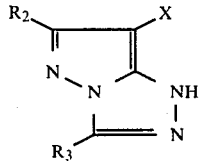

(IV)

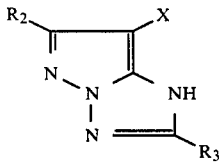

(V)

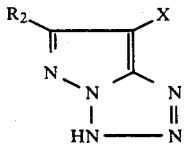

(VI)

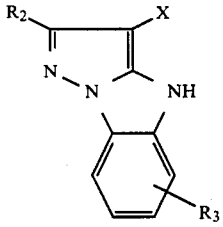

(VII)

Each of substituents $R_2$, $R_3$ and $R_4$ in the general formula (II) to (VII) represents a hydrogen atom, a halogen atom, an alkyl group, an aryl group, a heterocyclic group, a cyano group, an alkoxy group, an aryloxy group, a heterocyclicoxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclicthio group, an alkoxycarbonylamino group, an alyloxycarbonylamino group, a sulfonamido group, a carbamoyl group, an acyl group, a sulfamoyl group, a sulfonyl group, an alkoxycarbonyl group or an aryloxycarbonyl group, and X represents a hydrogen atom, a halogen atom, a carboxy group or a group which is attached, through an oxygen atom, a nitrogen atom or a sulfur atom contained therein, to the carbon atom situated in the coupling position and can be eliminated from the compound upon a coupling reaction.

The substituent $R_2$, $R_3$, $R_4$ or X may be a divalent group which forms a bis compound. Further, when the moiety represented by the general formula (II) to (VII) is in a vinyl monomer, $R_2$, $R_3$ or $R_4$ represents a chemical bond or a linkage group through which the moiety represented by the general formula (II) to (VII) and the vinyl group are linked.

More specifically, the substituent $R_2$, $R_3$ or $R_4$ includes a hydrogen atom, a halogen atom (e.g., chlorine atom, bromine atom, etc.), an alkyl group (e.g., methyl group, propyl group, group, t-butyl group, trifluoromethyl group, tridecyl group, 3-(2,4-di-t-amylphenoxy)propyl group, 2-dodecyloxyethyl group, 3-phenoxypropyl group, 2-hexylsulfonylethyl group, a cylopentyl group, benzyl group, etc.), an aryl group (e.g., phenyl group, 4-t-butylphenyl group, 2,4-di-t-amylphenyl group, 4-tetradecaneamidophenyl group, etc.), a heterocyclic group (e.g., 2-furyl group, 2-thienyl group, 2-pyrimidinyl group, 2-benzothiazolyl group, etc.), a cyano group, an alkoxy group (e.g., methoxy group, ethoxy group, 2-methoxyethoxy group, 2-dodecyloxyethoxy group, 2-methanesulfonylethoxy group, etc.), an aryloxy group (e.g., phenoxy group, 2-methylphenoxy group, 4-t-butylphenoxy group, etc.), a heterocyclicoxy group (e.g., 2-benzimidazolyloxy group, etc.), an acyloxy group (e.g., acetoxy group, hexadecanoyloxy group, etc.), a carbamoyloxy group (e.g., N-phenylcarbamoyloxy group, N-ethylcarbamoyloxy group, etc.), a silyloxy group (e.g., trimethylsilyloxy group, etc.), a sulfonyloxy group (e.g., dodecylsulfonyloxy group, etc.), an acylamino group (e.g., acetamido group, benzamido group, tetradecanamido group, α-(2,4-di-t-amylphenoxy)butylamido group, α-(3-t-butyl-4-hydroxyphenoxy)butylamido group, α-{4-(4-hydroxyphenylsulfonyl)phenoxy}decanamido group, etc.), an anilino group (e.g., phenylamino group, 2-chloroanilino group, 2-chloro-5-tetradecanamidoanilino group, 2-chloro-5-dodecyloxycarbonylanilino group, N-acetylanilino group, 2-chloro-5-{α-(3-t-butyl-4-hydroxyphenoxy)dodecanamido}anilino group, etc.), a ureido group (e.g., phenylureido group, methylureido group, N,N-dibutylureido group, etc.), an imido group (e.g., N-succinimido group, 3-benzylhydantoinyl group, 4-(2-ethylhexanoylamino)phthalimido group, etc.), a sulfamoylamino group (e.g., N,N-dipropylsulfamoylamino group, N-methyl-N-decylsulfamoylamino group, etc.), an alkylthio group (e.g., methylthio group, octylthio group, tetradecylthio group, 2-phenoxyethylthio group, 3-phenoxypropylthio group, 3-(4-t-butylphenoxy)propylthio group, etc.), an arylthio group (e.g., phenylthio group, 2-butoxy-5-t-octylphenylthio group, 3-pentadecylphenylthio group, 2-carboxyphenylthio group, 4-tetradecanamidophenylthio group, etc.), a heterocyclicthio group (e.g., 2-benzothiazolylthio group, etc.), an alkoxycarbonylamino group (e.g., methoxycarbonylamino group, tetradecyloxycarbonylamino group, etc.), an aryloxycarbonylamino group (e.g., phenoxycarbonylamino group, 2,4-di-tert-butylphenoxycarbonylamino group, etc.), a sulfonamido group (e.g., methanesulfonamido group, hexadecanesulfonamido group, benzenesulfonamido group, p-toluenesulfonamido group, octadecanesulfonamido group, 2-methyloxy-5-t-buthylbenzenesulfonamido group, etc.), a carbamoyl group (e.g., N-ethylcarbamoyl group, N,N-dibutylcarbamoyl group, N-(2-dodecyloxyethyl)-carbamoyl group, N-methyl-N-dodecylcarbamoyl group, N-{3-(2,4-di-tert-amylphenoxy)propyl}carbamoyl group, etc.), an acyl group (e.g., acetyl group, (2,4-di-tert-amylphenoxy)acetyl group, benzoyl group, etc.), a sulfamoyl group (e.g., N-ethylsulfamoyl group, N,N-dipropylsulfamoyl group, N-(2-dodecyloxyethyl)sulfamoyl group, N-ethyl-N-dodecylsulfamoyl group, N,N-diethylsulfamoyl group, etc.), a sulfonyl group (e.g., methanesulfonyl group, octanesulfonyl group, benzenesulfonyl group, toluenesulfonyl group, etc.), a sulfinyl group (e.g., octanesulfinyl group, dodecylsulfinyl group, phenylsulfinyl group, etc.), an alkoxycarbonyl group (e.g., methoxycarbonyl group, butyloxycarbonyl group, dodecylcarbonyl group, octadecylcarbonyl group, etc.), and an aryloxycarbonyl group (e.g., phenyloxycarbonyl group, 3-pentadecyloxycarbonyl group, etc.). The substituent X includes a hydrogen atom, a halogen atom (e.g., chlorine atom, bromine atom, iodine atom, etc.), a carboxyl group, a group linking via an oxygen atom (e.g., acetoxy group, propanoyloxy group, benzoyloxy group, 2,4-dichlorobenzoyloxy group, ethoxyoxaloyloxy group, pyruvoyl group, cinnamoyloxy group, phenoxy group, 4-cyanophenoxy group, 4-methanesulfonamidophenoxy group, 4-methanesulfonylphenoxy group, α-naphthoxy group, 3-pentadecylphenoxy group, benzyloxycarbonyloxy group, ethoxy group, 2-cyanoethoxy group, benzyloxy group, 2-phenetyloxy group, 2-phenoxyethoxy group, 5-phenyltetrazolyloxy group, 2-benzothiazolyloxy group, etc.), a group linking via a nitrogen atom (e.g., benzenesulfonamido group, N-ethyltoluenesulfonamido group, heptafluorobutaneamido group, 2,3,4,5,6-pentafluorobenzamido group, octanesulfonamido group, p-cyanophenylureido group, N,N-diethylsulfamoylamino group, 1-piperidyl group, 5,5-dimethyl-2,4-dioxo-3-oxazolidinyl group, 1-benzylethoxy-3-hydantoinyl group, 2N-1,1-dioxo-3-(2H)-oxo-1,2-benzoylthiazolyl group, 2-oxo-1,2-dihydro-1-pyridinyl group, imidazolyl group, pyrazolyl group, 3,5-diethyl-1,2,4-triazole-1-yl group, 5- or 6-bromo-benzotriazole-1-yl group, 5-methyl-1,2,3,4-tetrazole-1-yl group, benzimidazolyl group, 3-benzyl-1-hydantoinyl group, 1-benzyl-5-hexadecyloxy-3-hydantoinyl group, 5-methyl-1-tetrazolyl group, 4-methoxyphenylazo group, 4-pivaloylaminophenylazo group, 2-hydroxy-4-propanoylphenylazo group, etc.), and a group linking via sulfur atom (e.g., phenylthio group, 2-carboxyphenylthio group, 2-methoxy-5-t-octylphenylthio group, 4-methanesulfonylphenythio group, 4-octanesulfonamidophenylthio group, 2-butoxyphenylthio group, 2-(2-hexanesulfonylethyl)-5-t-octylphenylthio group, benzylthio group, 2-cyanoethylthio group, 1-ethoxycarbonyltridecylthio group, 5-phenyl-2,3,4,5-tetrazolylthio group, 2-benzothiazolylthio group, 2-dodecylthio-5-thiophenylthio group, 2-phenyl-3-dodecyl-1,2,4-triazolyl-5-thio group, etc.).

When $R_2$, $R_3$, $R_4$ or X is a divalent group which forms a bis compound, such a divalent group includes a substituted or unsubstituted alkylene group (e.g., methylene group, ethylene group, 1,10-decylene group, $—CH_2CH_2—O—CH_2CH_2—$, etc.), a substituted or unsubstituted phenylene group (e.g., 1,4-phenylene, 1,3-phenylene,

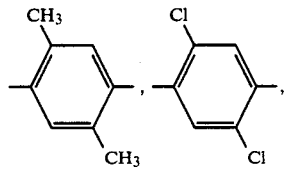

etc.), a group represented by $—NHCO—R_5—CONH—$ (wherein $R_5$ represents a substituted or unsubstituted alkylene or phenylene group), and so on.

When the moiety represented by the general formula (II) to (VII) is in a vinyl monomer, a linkage group represented by $R_2$, $R_3$ or $R_4$ includes those formed by combining two or more of divalent groups selected from among a substututed or unsubstituted alkylene group (e.g., a methylene group, an ethylene group, a 1,10-decylene group, $—CH_2CH_2OCH_2CH_2—$, etc.), a substituted or unsubstituted phenylene group (e.g., 1,4-phenylene group, 1,3-phenylene group,

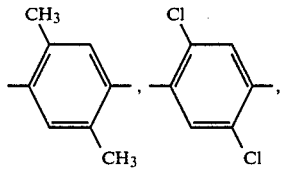

etc.), —NHCO—, —CONH—, —O—,

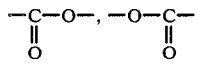

and a substituted or unsubstituted aralkylene group (e.g., 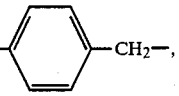

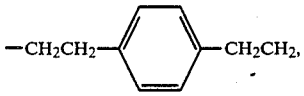

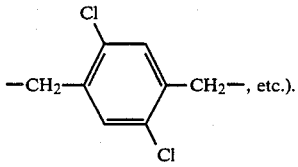

The vinyl group in such a vinyl monomer may contain a substitutent group in addition to the moiety represented by the general formula (II) to (VII). Preferred substituent groups include a hydrogen atom, a chlorine atom, or a lower alkyl group having from 1 to 4 carbon atoms.

Suitable examples of the non-color-forming ethylenically unsaturated monomer which cannot undergo the coupling reaction with an oxidation product of an aromatic primary amine developing agent include acrylic acid, α-chloroacrylic acid, α-alkylacrylic acid (e.g., methacrylic acid, etc.), and esters or amides derived from these arcylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxymethacrylate), methylenedibisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic acid estes, N-vinyl-2-pyrrolidone, N-vinylpyridine, 2- and 4-vinylpyridine, and so on. Two or more of the non-color-forming ethylenically unsaturated monomers may be used together.

Examples of couplers represented by the general formulae (II) to (VII), respectively, and synthesis examples thereof are described below. Namely, specific compound and synthesis examples of couplers represented by the general formula (II) are described in Japanese Patent Application (OPI) No. 162548/84, etc., those of couplers represented by the general formula (III) are described in Japanese Patent Application No. 151354/83, etc., those of couplers represented by the general formula (IV) are described in Japanese Patent Publication No. 27411/72, etc., those of couplers represented by the general formula (V) are described in Japanese Patent Application (OPI) No. 172982/85, U.S. Pat. No. 4,540,654, etc., those of couplers represented by the general formula (VI) are described in Japanese Patent Application (OPI) No. 33552/85, etc., and those of couplers represented by the general formula (VII) are described in U.S. Pat. No. 3,061,432, etc.

Also, ballast group excellent in color forming ability, which are described in U.S. Pat. No. 4,443,536, Japanese Patent Application (OPI) Nos. 214854/84, 177245/84, 177554/84 and 177557/84, etc., can be introduced into the compounds represented by the general formulae (II) to (VII), respectively.

Specific examples of pyrazoloazole type couplers to be employed in the present invention are illustrated below. However, the present invention should not be construed as being limited to the following examples.

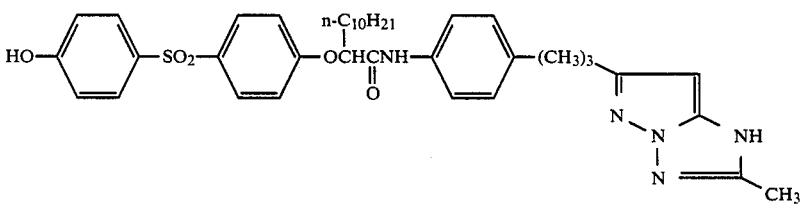

(M-1)

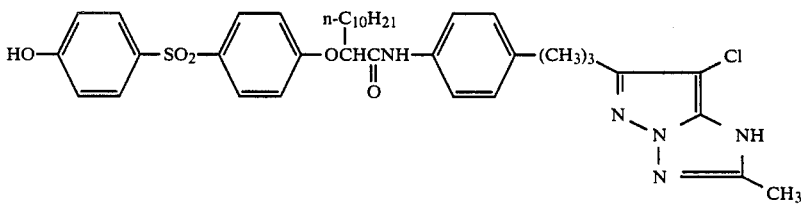

(M-2)

-continued
(M-3)
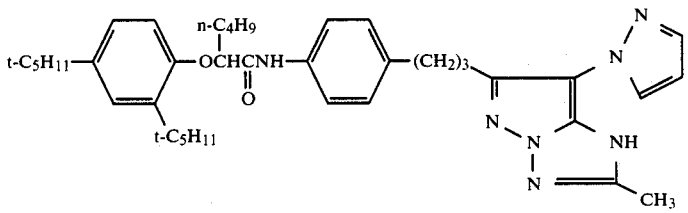
(M-4)
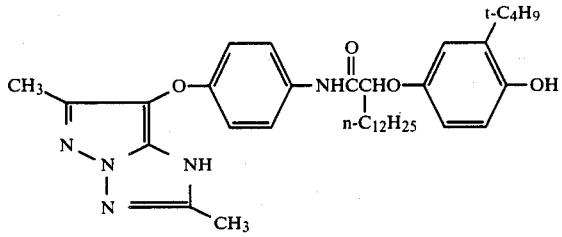
(M-5)
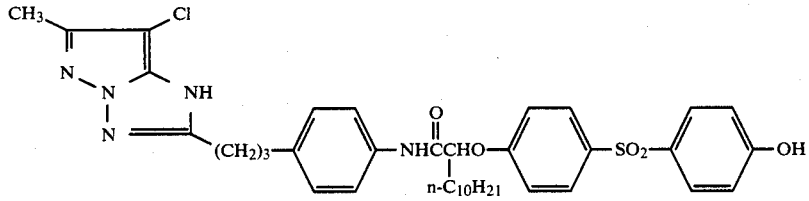
(M-6)
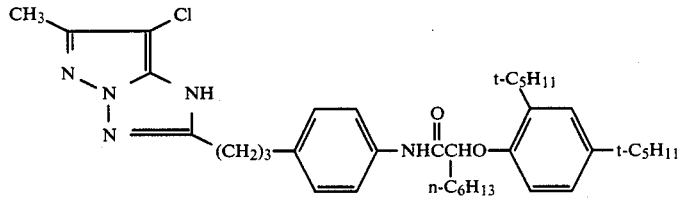
(M-7)
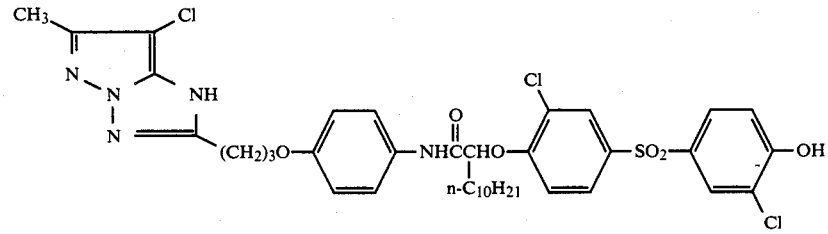
(M-8)
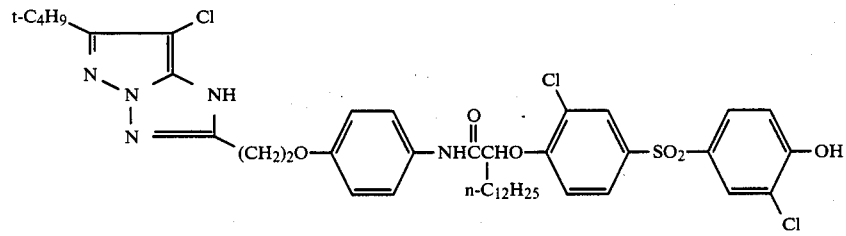
(M-9)
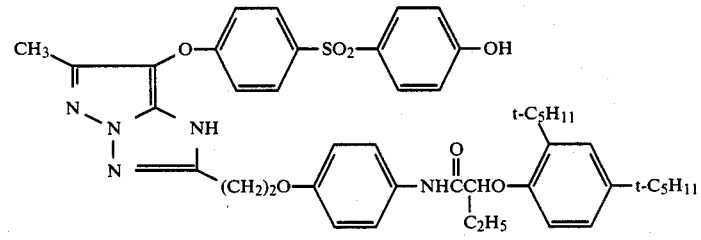

-continued
(M-10)
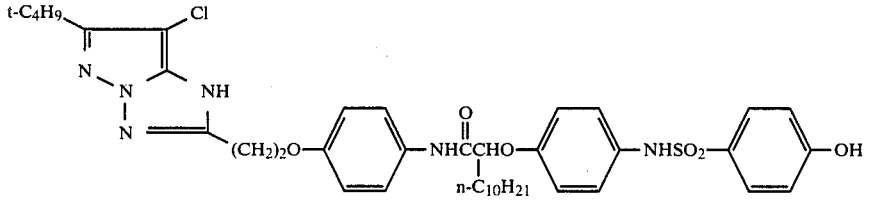
(M-11)
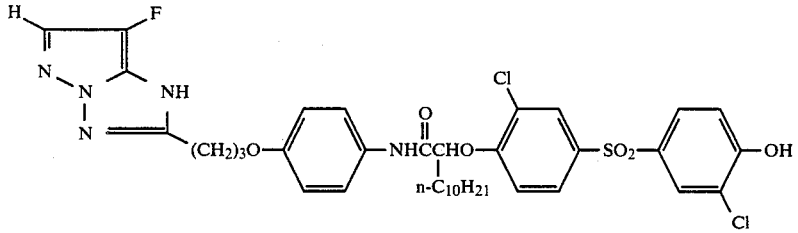
(M-12)
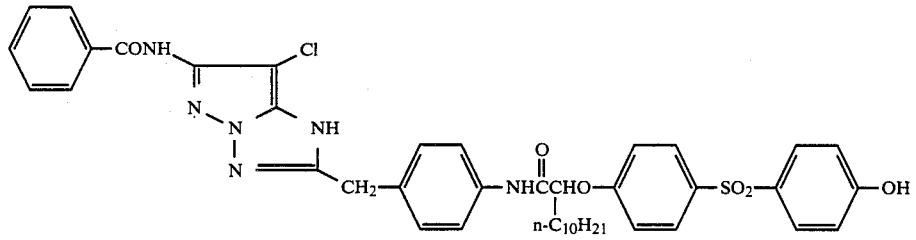
(M-13)
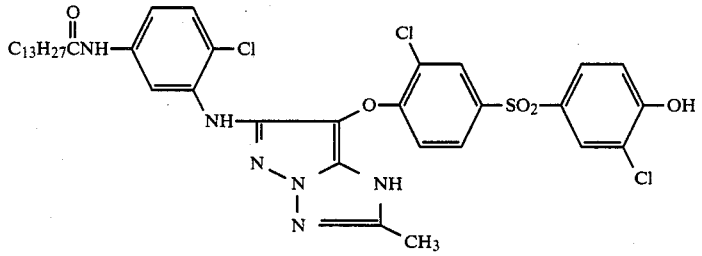
(M-14)
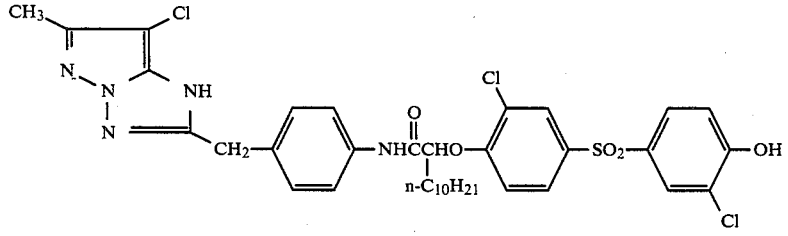
(M-15)
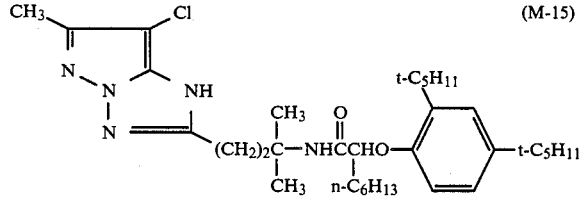
(M-16)
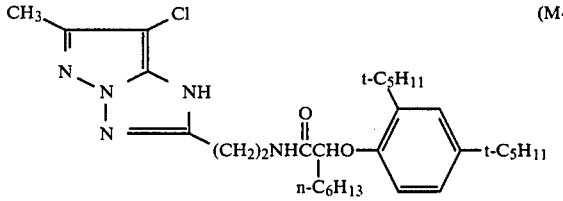
(M-17)
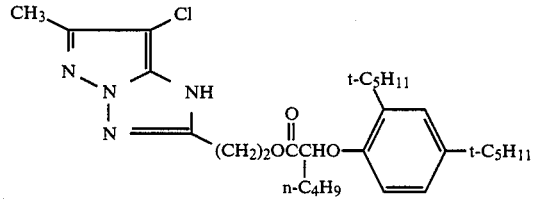

-continued
(M-18)
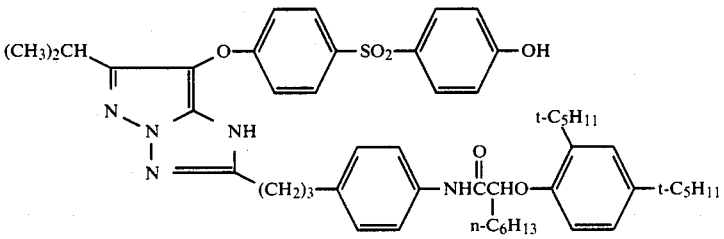
(M-19)
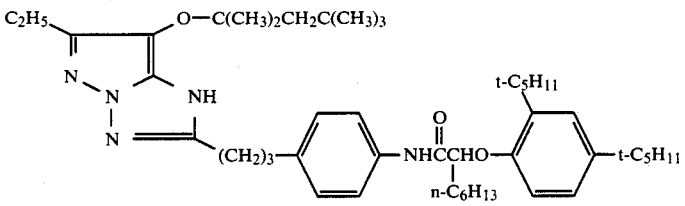
(M-20)
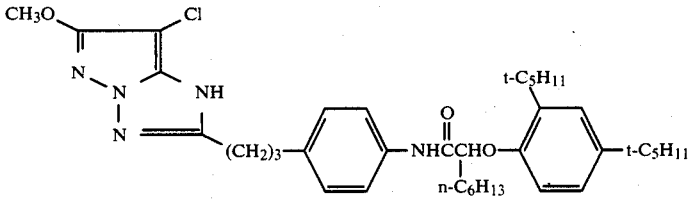
(M-21)
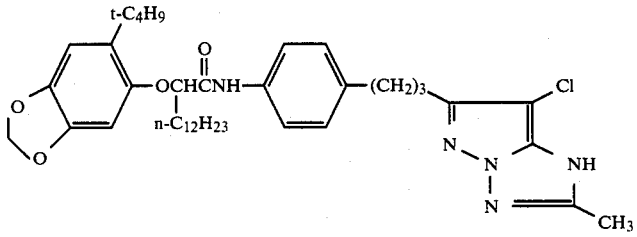
(M-22)
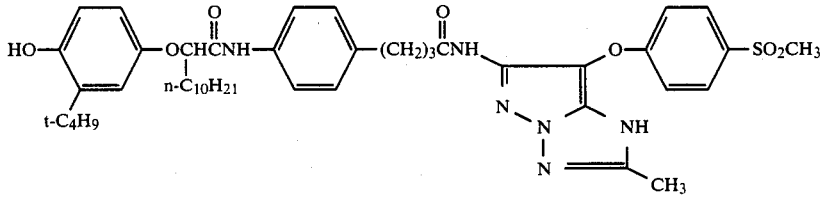
(M-23)
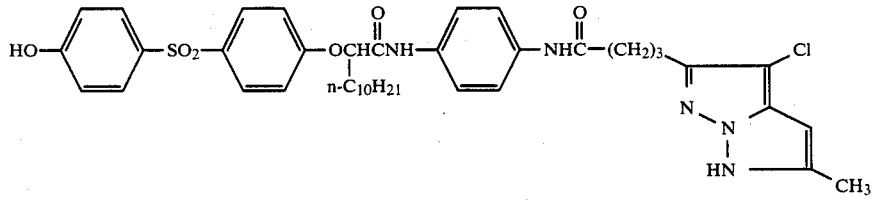
(M-24)
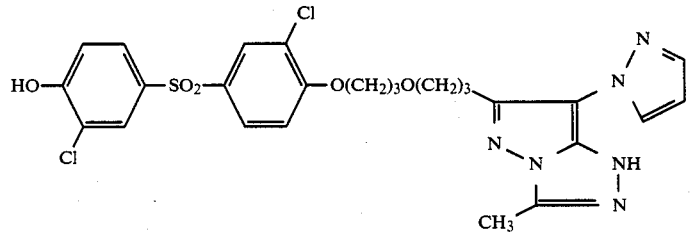

-continued
(M-25)
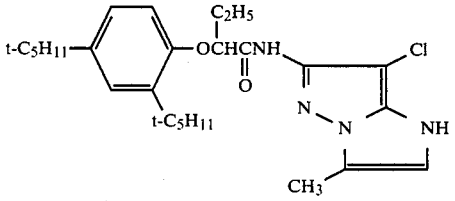
(M-26)
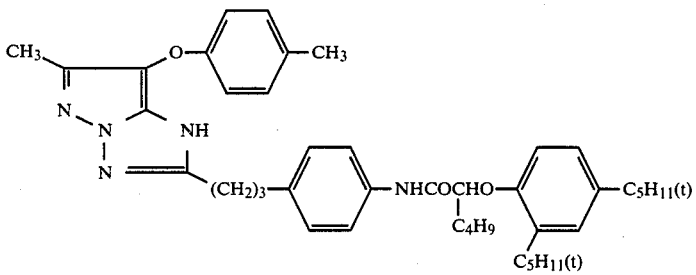
(M-27)
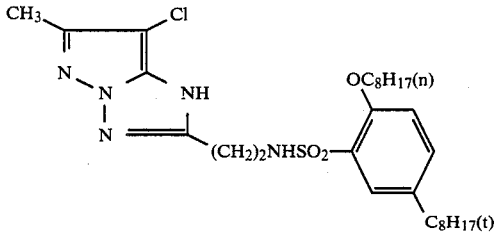
(M-28)
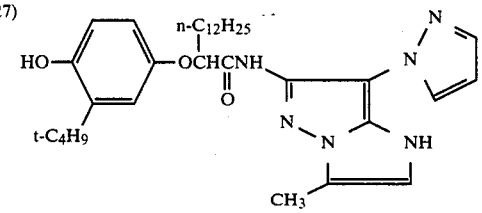
(M-29)
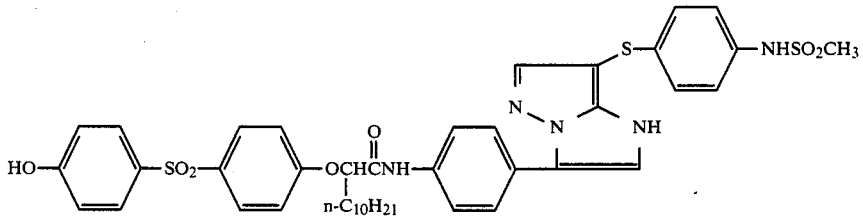
(M-30)
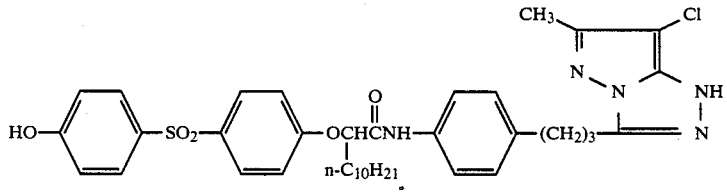
(M-31)
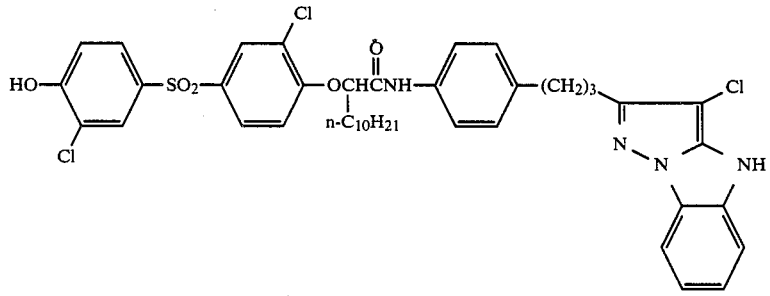

-continued
(M-32)
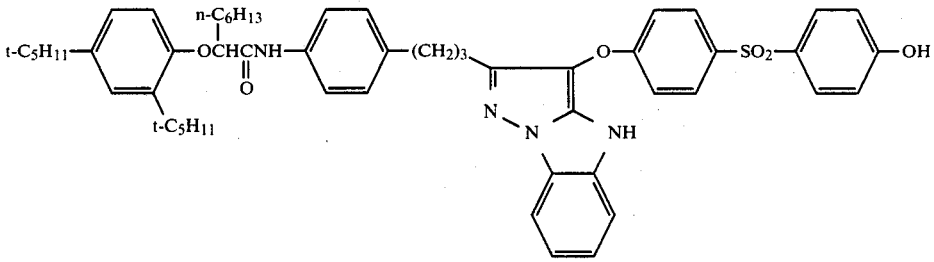
(M-33)
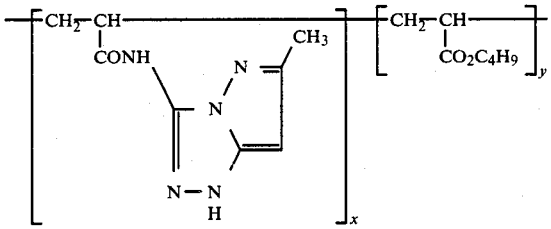
x:y = 50:50
(weight ratio)
(M-34)
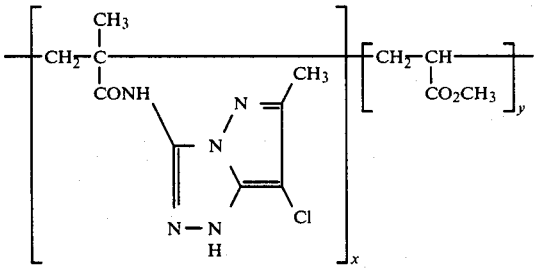
x:y = 40:60
(weight ratio)
(M-35)
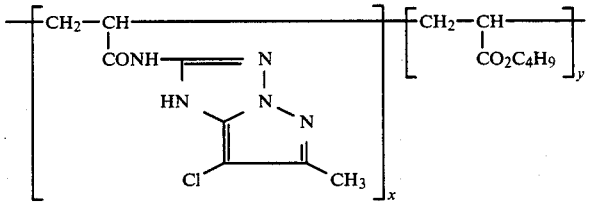
x:y = 50:50
(weight ratio)
(M-36)
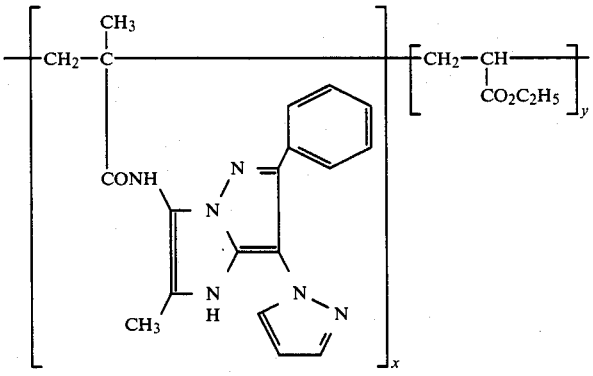
x:y = 55:45
(weight ratio)
(M-37)
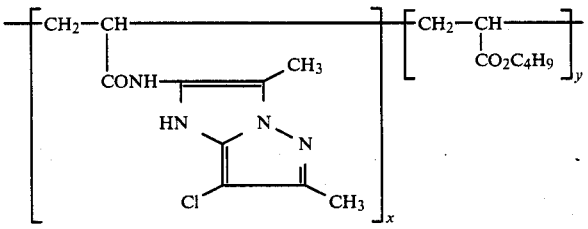
x:y = 50:50
(weight ratio)

These couplers are generally used in a range of from $2\times10^{-3}$ to $5\times10^{-1}$ mol, and more preferably from $1\times10^{-2}$ to $5\times10^{-1}$ mol, per mol of silver contained in an emulsion layer.

Two or more of the above-described couplers can be incorporated in the same layer for the purpose of satisfying characteristics required of photosensitive materials, and the same compound can naturally be added to two or more of different layers.

Couplers are incorporated into silver halide emulsion layers using known processes, for example, the process described in U.S. Pat. No. 2,322,027. Specifically, couplers are dissolved in a high boiling point organic solvent such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyl laurylamide, etc.), fatty acid esters (e.g., dibutoxy ethyl succinate, diethyl azelate, etc.), trimesic acid esters (e.g., tributyl trimesate, etc.) and the like, or in a low boiling point organic solvent having a boiling point of from about 30° C. to 150° C., such as lower alkyl acetates (e.g., ethyl acetate, butyl acetate, etc.), ethyl propionate, sec-butyl alcohol, methyl isobutyl ketone, $\beta$-ethoxyethyl acetate, methyl cellosolve acetate, etc., and then the resulting solution is dispersed in a hydrophilic colloid. The above-described high and low boiling point organic solvents may be used in combination.

The final bath to be used in the present invention is a bath situated at the end of the photographic processing, and generally means a bath employed just before the drying step. In general, the final bath is mostly a washing bath or a stabilizing bath. However, it should not be limited to these baths.

When the final bath is a washing bath, it is necessary for the washing bath to be that of the multistage countercurrent type, and it is particularly preferable to be constructed by 3 to 9 tanks. To this washing water, known compounds can be added, if desired. For example, a water softener such as an inorganic phosphoric acid, an aminopolycarboxylic acid, an organic phosphoric acid, etc., a germicide for preventing multiplication of various kinds of bacteria and waterweed, a hardener represented by magnesium salts and aluminium salts, and a surface active agent for lightening drying load and preventing water mark can be added as occasion demands. Also, the compounds described in L. E. West, *Water Quality Criteria;* Photographic Science and Engineering, Vol. 9, No. 6 (1965); and so on may be added thereto.

When the final bath is a stabilizing bath, the pre-bath thereof may be either a washing bath having not less than one tank or a stabilizing bath of the multistage countercurrent type without a washing process as described in U.S. Pat. No. 4,336,324. In the case of multistage countercurrent stabilization processing step, it is necessary for the stabilizing bath to have 2 to 9 tanks.

To the above-described stabilizing bath, various kinds of compounds can be added. As an example of such additives, mention may be made of a pH buffering agent such as a borate, a metaborate, borax, a phosphate, a carbonate, potassium hydroxide, sodium hydroxide, aqueous ammonia, a monocarbonic acid, a dicarbonic acid, a polycarbonic acid or so on.

A water softener such as an inorganic phosphoric acid, an aminopolycarboxylic acid, an organic phosphoric acid, an aminopolyphosphonic acid, phosphonocarboxylic acid or so on can offer another example of such additives.

Other known examples of such additives include antimolds agent such as Prokicell and 4-thiazolylbenzimidazole, hardeners such as formaldehyde, aluminium salts and magnesium salts, surface active agents, and so on.

In addition, various ammonium salts such as ammonium chloride, ammonium nitrate, ammonium sulfate, ammonium phosphate, ammonium sulfite, ammonium thiosulfate and the like can be added as an agent for properly adjusting a pH of the processed film.

In the present invention, it is essential for the final bath to contain at least $1\times10^{-4}$ mol/l of a soluble iron salt.

The term soluble iron salt refers to the iron salt which can be complexed substantially with various kinds of chelating agents in the bath. Specific examples of the typical chelating agents are illustrated below. However, they should not be construed as being limited to these examples.

$Na_4P_4O_{12}$ F-1

$Na_6P_4O_{13}$ F-2

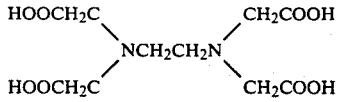
F-3

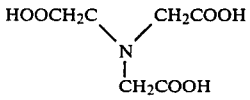
F-4

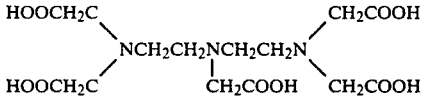
F-5

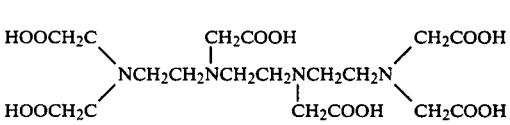
F-6

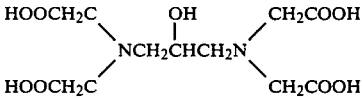
F-7

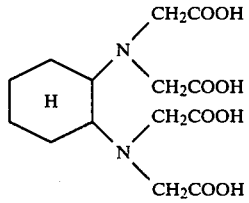
F-8

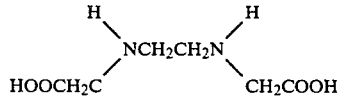
F-9

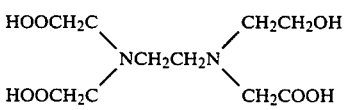
F-10

-continued

F-11

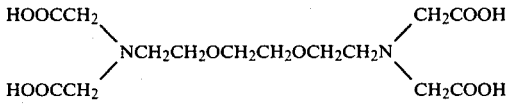

F-12

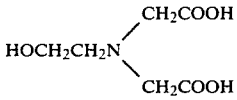

F-13

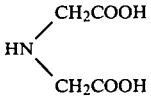

F-14

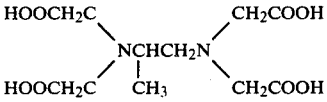

F-15

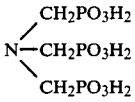

F-16

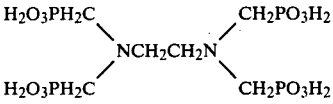

F-17

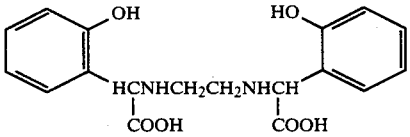

F-18

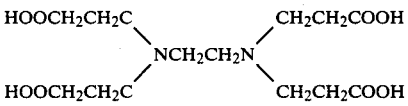

F-19

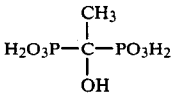

F-20

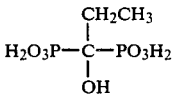

F-21

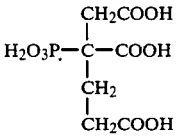

F-22

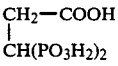

F-23

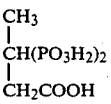

F-24

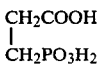

-continued

F-25

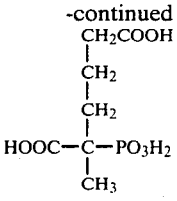

F-26

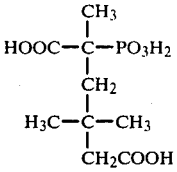

F-27

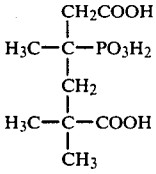

F-28

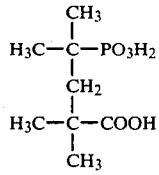

F-29

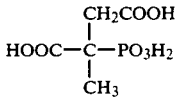

F-30

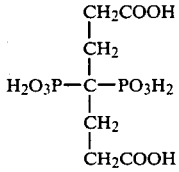

F-31

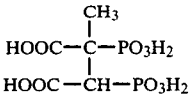

F-32

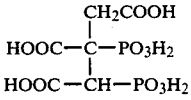

F-33

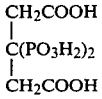

Carboxylic groups or phospho groups in these chelating agents may form salts together with sodium, potassium, ammonia or the like.

The water soluble iron salt to be employed in the present invention can be contained in the final bath in a concentration ranging from $1\times10^{-4}$ to $1\times10^{-1}$ mol/l, preferably from $2\times10^{-4}$ to $1\times10^{-2}$ mol/l.

The above-described soluble iron salt may be added to the final bath, or may be contained in a prebath like a bleaching bath or a bleach-fix bath. The latter case is permissible so long as a concentration of the soluble iron salt, e.g., an ethylenediamine-iron complex salt, carried from the prebath into the final bath in the course of photographic processing is in the above-described range. Namely, if the final bath corresponds to the washing step of the multistage countercurrent type, it becomes possible to reduce the amount of washing water by from one over several decades to one over several hundreds from the standpoint of ensuring the above-described concentration range.

A suitable pH value of the final bath in the present invention is 3 to 9, preferably 4 to 8. When the pH value is beyond this limit, the ability to prevent discoloration of cyan dyes is impaired. A temperature of the final bath is controlled to from 5° C. to 40° C., preferably from 10° C. to 35° C.

The processing method of the present invention can be applied in any processings of conventional silver halide color photosensitive materials such as color negative films, color papers, color positive films, color reversal films, etc. In particular, this method can achieve good results when employed for color papers.

Representative processing steps employable in the present invention are illustrated below, but the present invention should not be construed as being limited thereto.

A. Color development—bleach-fix—washing—drying
B. Color development—beach-fix—washing—stabilization—drying
C. Color development—bleach-fix—stabilization—drying
D. color development—washing—bleach-fix—washing—drying
F. Color development—bleaching—fixation—washing—stabilization—drying
G. Color development—bleaching—fixation—washing—drying
H. Color development—bleaching—fixation—stabilization—drying The color developing solution to be employed in the present invention contains a color developing agent. Preferred examples of the color developing agent include p-phenylenediamin derivatives, and the representatives thereof are described below. However, the present invention should not be construed as being limited to these examples.

D-1 N,N-diethyl-p-phenylenediamine
D-2 2-Amino-5-diethylaminotoluene
D-3 2-Amino-5-(N-ethyl-N-laurylamino)toluene
D-4 4-[N-ethyl-N-(β-hydroxyethyl)amino]aniline
D-5 2-Methyl-4-[N-ethyl-N-(β-hydroxyethyl-)amino]aniline
D-6 N-ethyl-N-(β-methanesulfonamidoethyl)-3-methyl-4-aminoaniline
D-7 N-(2-amino-5-diethylaminophenylethyl)methanesulfonamide
D-8 N,N-dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline These p-phenylenediamine derivatives may be salts such as sulfates, hydrochlorides, sulfites, p-toluenesulfonates, etc. The above compounds are described in U.S. Pat. Nos. 2,193,015, 2,552,241, 2,566,271, 2,592,364, 3,656,950, 3,698,525 and so on. Such aromatic primary amine developing agent is used in an amount of about 0.1 g to about 20 g, preferably about 0.5 g to about 10 g, per liter of the developing solution.

The color developing solution to be employed in the present invention can contain hydroxylamines as it is universally known.

Hydroxylamines are usually used in the form of a water-soluble acid salt rather than a free amine, although they can be used in the form of a free amine. General examples of such salts include sulfates, oxalates, chlorides, phosphates, carbonates, acetates and so on. These hydroxylamines employed in the present invention include both substituted and unsubstituted ones, and the nitrogen atom in the hydroxylamines may also be substituted with alkyl groups.

The color developing solution to be employed in the present invention is preferably adjusted to pH 9 to 12, more preferably 9 to 11.0, and it can contain, in addition to the above-described ingredients, compounds known as other ingredients of a color developing solution. For instance, sodium hydroxide, potassium hydroxide, sodium carbonate, potassium carbonate, sodium tertiary phosphate, potassium tertiary phosphate, potassium metaborate, borax and the like can be contained alone or in combination thereof as an alkali agent or a pH buffering agent. For the purpose of imparting a buffering capability, providing a convinience for the facility of preparation, heightening ionic strenth, or so on, various salts such as disodium or dipotassium hydrogen phosphate, potassium or sodium dihydrogen phosphate, sodium or potassium bicarbonate, boric acid, alkali nitrates, alkali sulfates and the like can further be added to the color developing solution.

In addition, the color developing solution can contain various kinds of chelating agents in order to prevent calcium, magnesium and the like from precipitating. Suitable chelating agents for this purpose include polyphosphates, aminpolycarboxylic acids, phosphocarboxylic acids, aminopolyphosphonic acids, 1-hydroxyalkylidene-1,1-diphosphonic acids and so on.

The color developing solution can contain an arbitrary development accelerator, if needed. For instance, various kinds of pyrimidium compounds and other cationic compounds, as described in U.S. Pat. No. 2,648,604, Japanese Patent Publication No. 9503/69, U.S. Pat. No. 3,171,247, and so on, cationic dyes like phenosafranine, neutral salts like thallium nitrate and potassium nitrate, nonionic compounds, such as polyethylene glycols and derivatives thereof, polythioethers, etc., as described in Japanese Patent Publication No. 9304/69, and U.S. Pat. Nos. 2,533,990, 2,531,832, 2,950,970 and 2,577,127, and thioether compounds as described in U.S. Pat. No. 3,201,242 can be used as development accelerator.

Further, the color developing solution can contain sodium sulfite, potassium sulfite, potassium bisulfite or sodium bisulfite which has usually been used as preservative.

The color developing solution to be employed in the present invention can contain an arbitrary antifoggant, if desired. As a suitable antifoggant, an alkali metal halide such as potassium bromide, sodium bromide, potassium iodide or the like, and an organic antifoggant can be used. Specific examples of the organic antifoggants which can be used include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolidine, etc., mercapto-substituted heterocyclic compounds such as 1-phenyl-5-mercaptotetrazole, 2-mercaptobenzimidazole, 2-mercaptobenzothiazole, etc., and mercapto-substituted aromatic compounds like thiosalicylic acid. Of these antifoggants, the nitrogen-containing heterocyclic compounds are particularly preferred. These antifoggants may be accumulated in the color developing solution as the result of elution from the photosensitive materials.

A bleaching bath or a bleach-fix bath which can be used in the present invention contains an iron complex as a bleaching agent. Preferred iron complexes are aminopolycarboxylato iron complex salts, and they are added in an amount ranging from 0.01 to 1.0 mol/l, preferably from 0.05 to 0.50 mol/l. On the other hand, a fixing bath or a bleach-fix bath which can be used in the present invention contains thiosulfates or rhodanates as fixing agent. Of these fixing agents, ammonium thiosulfate is preferred. As for the preservative to be added to the above-describe bath, sulfites are generally used, but ascorbic acid, adducts of carbonyl compounds and bisulfites, or carbonyl compounds may be used. Further, a buffer, a brightening agent, a chelating agent, an antimold agents and so on may be added as occasion demands.

Photographic emulsions used in the present invention can be prepared using precesses described in P. Glafkides, *Chimie et Physique Photographique* (Paul Montel Inc., 1967); G. F. Duffin, *Photographic Emulsion Chemistry* (Focal Press Inc., 1966); V. L. Zelikman et al., *Making and Coating Photographic Emulsion* (Focal Press Inc., 1964); etc. Namely, any of an acid process, a neutral process, an ammonia process and the like may be used.

Suitable methods for reacting a water-soluble silver salt with a water-soluble halide include, e.g., a single jet methods, a double jet method or a combination thereof.

Also, a method in which silver halide grains are produced in the presence of excess silver ion (the so-called reverse mixing method) can be employed. On the other hand, the so-called controlled double jet methods, in which the pAg of the liquid phase in which silver halide grains are to be precipitated is maintained constant, may be also employed.

Examples of silver halide which may be present in the photographic emulsions of the present invention include silver bromide, silver iodobromide, silver iodochlorobromide, silver chlorobromide and silver chloride.

In a process of producing the silver halide grains or allowing the produced silver halide grains to ripen physically, cadmium salts, zinc salts, lead salts, thallium salts, iridium salts or complexes, rhodium salts or complexes, iron salts or complexes and/or the like may be present.

The silver halide emulsions are usually chemically sensitized. Chemical sensitization can be carried out in accordance with the processes described, for example, in H. Frieser, *Die Grundlagen der Photographischen Prozesse mit Silberhalogeniden* (Akademische Verlagsgesellschaft, 1968), pages 675–734.

More specifically, sulfur sensitization using sulfur-containing compounds capable of reacting with active gelatin or silver (e.g., thiosulfates, thioureas, mercapto compounds, rhodanines, etc.), reduction sensitization using reducing substances (e.g., stannous salts, amines, hydrazine derivatives, formamidinesulfinic acid, silane compounds, etc.), and noble metal sensitization using noble metal compounds (e.g., gold complex salts and complex salts of Group VIII metals such as Pt, Ir, Pd, etc.) can be used alone or in combination.

The photographic emulsions used in the present invention may contain various compounds for the purpose of preventing fog during production of the light-sensitive material, during presesrvation before use, or during photographic processing thereof, or for the purpose of stabilizing photographic properties. Suitable examples of such compounds include various compounds known as an antifoggant or stabilizer, such as azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines; thioketo compounds such as oxazolinethione; azaindenes, e.g., triazaindenes, tetraazaindenes (particularly, 4-hydroxy-substituted-(1,3,3a,7)tetraazaindenes), pentaazaindenes, etc.; benzenethiosulfonic acid, benzenesulfinic acid, benzenesulfonic acid amide, and so on.

The photographic emulsions used in the present invention may be spectrally sensitized using methine dyes or other dyes. Suitable spectral sensitizing dyes which can be employed include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. Any nuclei usually present in cyanine dyes can be the basic heterocyclic nuclei of these dyes.

As a binder or a protective colloid to constitute the photographic emulsions of the present invention, gelatin is advantageously used, but other hydrophilic colloids can be used alone or together with gelatin.

Suitable examples of hydrophilic colloids which can be used in the present invention include proteins such as gelatin derivatives, graft polymers prepared from gelatin and other high polymers, albumin, casein, etc.; sugar derivatives such as cellulose derivatives, e.g., hydroxyethyl cellulose, carboxyethyl cellulose, cellulose sulfate or the like, sodium alginate, starch derivatives, etc.; and various kinds of synthetic hydrophilic high polymers including homo- and co-polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

In the photographic material of the present invention, the photographic emulsion layers and other hydrophilic colloid layers may contain inorganic or organic hardeners. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), or so on can be used alone or in combination.

In the photosensitive materials prepared in accordance with the present invention, when dyes, ultraviolet ray absorbing agent and the like are incorporated in hydrophilic colloid layers, they may be mordanted with cationic polymers, etc.

The photosensitive materials prepared in accordance with the present invention may contain hydroquinone derivatives, aminophenol derivatives, gallic acid derivatives, ascorbic acid derivatives and so on as a color fog preventing agent.

The photosensitive materials prepared in accordance with the present invention may contain ultraviolet ray absorbing agents in hydrophilic colloid layers. For example, benzotriazole compounds substituted by an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanease patent Application (OPI) No. 2784/71), cinnamic acid ester compounds (e.g., those described in U.S. Pat. Nos. 3,705,805 and 3,707,375), butadiene compounds (e.g., those described in U.S. Pat. No. 4,045,229), and benzoxazole compounds (e.g., those described in U.S. Pat. No. 3,700,455) can be used. Ultraviolet ray absorbing agents described in U.S. Pat. No. 3,499,762 and Japanese Patent Application No. 48535/79 can also be used. Ultraviolet ray absorbing couplers (e.g., α-naphthol type cyan couplers) and ultraviolet ray absorbing polymers may be used. These ultraviolet ray absorbing agents may be mordanted in a specific layer.

The photosensitive materials prepared in accordance with the present invention may contain water-soluble dyes as filter dyes or for various other purposes including prevention of irradiation. Such dyes include oxonol dyes, hemioxonol dyes, styryl dyes, merocyanine dyes, cyanine dyes and azo dyes. Of these dyes, oxonol dyes, hemioxonol dyes and merocyanine dyes are particularly useful.

In carrying out the present invention, the following known discoloration inhibitors can be used together, and the color image stabilizers used in the present invention can be used alone or in combinations of two or more thereof. Known discoloration inhibitors include hydroquinone derivatives, gallic acid derivatives, p-alkoxyphenols, p-oxyphenol derivatives, bisphenols, etc.

In the photosensitive materials prepared in accordance with the present invention, brightening agents of the stilbene type, triazine type, oxazole type, coumarin type or so on may be contained in photographic emulsion layers or other hydrophlic colloid layers. These agents may be either water-soluble ones or water-insoluble ones. When brightening agents are insoluble in water, they are used in the form of a dispersion. Specific examples of the brightening agents are described in U.S. Pat. Nos. 2,632,701, 3,269,840 and 3,359,102, British Pat. Nos. 852,075 and 1,319,763, and so on.

Dye forming couplers, that is, compounds capable of forming colors by oxidative coupling with aromatic primary amine developing agents (e.g., phenylenediamine derivatives, aminophenol derivatives, etc.) in conventional color development processing, may be incorporated together with the coupler of the present invention in the photographic emulsion layers of the photographic material prepared in accordance with the present invention. Typical exmaples of magenta dye forming couplers include 5-pyrazolone couplers other than those represented by the foregoing general formula (I), cyanoacetylcumarone couplers, open-chain acylacetonitrile couplers and so on, those of yellow dye forming couplers include acylacetoamide couplers (e.g., benzoylacetoanilides, pivaloylacetoanilides. etc.) and so on, and those of cyan dye forming couplers include naphthol couplers and phenol couplers. These couplers are preferred to have a so-called ballast group which is a hydrophobic group or to be polymerized so as to render the coupler nondiffusible. Further, these couplers may be either two equivalent or four equivalent to silver ion. In addition, colored couplers having color correcting effect, and couplers which release a development inhibitor or a development accelerator (the so-called DIR coupler and DAR coupler, respectively) upon coupling reaction may be used. Furthermore, colorless DIR coupling compounds which give colorless products and release development inhibitors upon coupling reaction may be incorporated other than the DIR couplers.

Also, compounds which release development inhibitors upon development, other than DIR couplers, may be incorporated in the photosensitive material.

In addition to the compound represented by the general formula (I) which is essential to the present invention as magenta coupler to be incorporated in the photographic material, other magneta couplers as described in U.S. Pat. Nos. 2,600,788, 2,983,608, 3,062,652, 3,127,269, 3,311,476, 3,419,391, 3,519,429, 3,558,319, 3,582,322, 3,615,506, 3,834,908 and 3,891,445, West German Patent Application (OLS) Nos. 2,408,665, 2,417,945, 2,418,959 and 2,424,467, West German Patent No. 1,810,464, Japanese Patent Publication 6031/65, Japanese Patent Application (OPI) Nos. 20826/76, 58922/77, 129538/74, 74027/74, 159336/75, 42121/77, 74028/74, 60233/75, 26541/76, 55122/78, 62454/80 and 35858/82, and so on may be used together.

As for the yellow coupler, those of benzoylacetoanilide type and those of pivaloylacetoanilide type are used to advantage. Specific examples of yellow couplers which can be used are described, e.g., in U.S. Pat. Nos. 2,875,057, 3,265,506, 3,408,194, 3,551,155, 3,582,322, 3,725,072 and 3,891,445, West German Patent No. 1,547,868, West German Patent Application (OLS) Nos. 2,219,917, 2,261,361 and 2,414,006, British Pat. No. 1,425,020, Japanese Patent Publication 10783/76, Japanese Patent Application (OPI) Nos. 26133/72, 73147/73, 102636/76, 6341/75, 123342/75, 130442/75, 21827/76, 87650/75, 82424/77 and 115219/77, and so on.

As for the cyan coupler, phenol compounds and naphthol compounds can be used. Specific examples of such compounds are described in U.S. Pat. Nos. 2,369,929, 2,434,272, 2,474,293, 2,521,908, 2,772,162, 2,895,826, 3,034,892, 3,311,476, 3,458,315, 3,476,563, 3,583,971, 3,591,383, 3,758,308, 3,772,002, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77, 90932/77, 163537/80, 99341/81, 116030/81, 80045/81, 104333/81, 155538/82, 204545/82, 105229/83, 31953/84, 31954/84 and 34536/84, and so on.

As for the colored couplers, those described, e.g., in U.S. Pat. Nos. 3,476,560, 2,521,908 and 3,304,892, Japanese Patent Publication Nos. 2016/69, 22335/63, 11304/67 and 32461/69, Japanese Patent Application (OPI) Nos. 26034/76 and 42121/77, and West German Patent Application (OLS) No. 2,418,959 can be used.

As for the DIR couplers, those described, e.g., in U.S. Pat. Nos. 3,227,554, 3,617,291, 3,701,783, 3,790,384 and 3,632,345, West German Patent Application (OLS) Nos. 2,414,006 and 2,454,301 and 2,454,329, British Pat. No. 935,454, Japanese Patent Application (OPI) Nos. 69624/77 and 122335/74, and Japanese Patent Publication No. 16141/76 can be used.

In addition to DIR couplers, compounds capable of releasing development inhibitors upon development may be incorporated in the photosensitive material, and those described, e.g., in U.S. Pat. Nos. 3,297,445 and 3,379,529, West German Patent Application (OLS) No. 2,417,914, and Japanese Patent Application (OPI) Nos. 15271/77 and 9116/78 can be used as such compounds.

Two or more of the above-described couplers can be incorporated in the same layer, or one of them may be contained in two or more of different layers.

Each of the couplers as described above is added in an amount ranging generally from $2\times10^{-3}$ to $5\times10^{-1}$ mol, and preferably from $1\times10^{-2}$ to $5\times10^{-1}$ mol, per mol of silver halide in the emulsion layer.

The present invention is illustrated in greater detail by reference to the following examples, but it should not be construed as being limited to these examples.

EXAMPLE 1

To a paper support laminated on both sides thereof with polyethylene, a first layer (the lowest layer) through a 7th layer (the uppermost layer) were applied, in the order as set forth in the following table, to prepare multilayer silver halide color photosensitive materials 1 to 13.

| Layer | Main Ingredient | Amount used ($g/m^2$) |
|---|---|---|
| 7th Layer (protective layer) | Gelatin | 1.62 |
| 6th Layer (ultra violet absorbing layer) | Gelatin | 1.06 |
| | Ultraviolet absorbent(*1) | 0.35 |
| | Ultraviolet absorbent solvent(*2) | 0.12 |
| 5th Layer (red-sensitive layer) | Red-sensitive silver chlorobromide emulsion (silver bromide content: 50 mol %) on silver basis | 0.25 |
| | Gelatin | 1.26 |
| | Cyan coupler(*3) | 0.50 |
| | Coupler solvent(*2) | 0.25 |
| 4th Layer (Ultraviolet absorbing layer) | Gelatin | 1.60 |
| | Ultraviolet absorbent(*1) | 0.70 |
| | Color mixing inhibitor(*4) | 0.20 |
| | Color mixing inhibitor solvent(*2) | 0.30 |
| 3rd Layer (green-sensitive layer) | Green-sensitive silver chlorobromide emulsion (silver bromide content: 70 mol %) on silver basis | 0.17 |
| | Gelatin | 1.40 |
| | Magenta coupler (Table 1) | 0.40 |
| | Coupler Solvent(*5) | 0.20 |
| 2nd Layer (interlayer) | Gelatin | 1.10 |
| | Color mixing inhibitor(*4) | 0.20 |
| | Color mixing inhibitor solvent(*2) | 0.10 |
| 1st Layer (blue-sensitive layer) | Blue-sensitive silver chlorobromide emulsion (silver bromide content: 70 mol %) on silver basis | 0.35 |
| | Gelatin | 1.54 |
| | Yellow coupler(*6) | 0.50 |
| | Coupler solvent(*2) | 0.50 |

-continued

| Layer | Main Ingredient | Amount used ($g/m^2$) |
|---|---|---|
| Support | Polyethylene-laminated paper containing white pigment ($TiO_2$, etc.) and blue pigment (ultramarine, etc.) in polyethylene of 1st layer side | |

(*1) 2-(2-Hydroxy-3-sec-butyl-5-t-butylphenyl)benzotriazole
(*2) Dibutyl phosphate
(*3) 2-[α-(2,4-Di-t-amylphenoxy)butaneamido]-4,6-dichloro-5-methylphenol
(*4) 2,5-Di-t-octylhydroquinone
(*5) Trioctyl phosphate
(*6) α-Pivaloyl-α-(2,4-dioxo-5,5-dimethyloxazolidine-3-yl)-2-chloro-5-[α-(2,4-di-t-amylphenoxy)butaneamido]acetoanilide In addition, sodium salt of 1-oxy-3,5-dichloro-S-triazine was used in each layer as gelatin hardener.

Each of the above-described photosensitive materials was exposed to light through an optical wedge, and processed in accordance with the following processing step.

| Processing Step | Temperature | Time |
|---|---|---|
| Color Development | 33° C. | 3 min 30 sec |
| Bleach-fix | 33° C. | 1 min 30 sec |
| Water Washing | 24–34° C. | 3 min |

The ingredients of each processing solution are described below.

| | |
|---|---|
| Color Developing Solution: | |
| Water | 800 ml |
| Sodium Tetrapolyphosphate | 2.0 g |
| Benzyl Alcohol | 14.0 g |
| Diethylene Glycol | 10.0 ml |
| Sodium Sulfite | 2.0 g |
| Potassium Bromide | 0.5 g |
| Sodium Carbonate | 30.0 g |
| N—Ethyl-N—(β-methanesulfonamidoethyl)-3-methyl-4-aminoaniline Sulfonate | 5.0 g |
| Hydroxyamine Sulfate | 4.0 g |
| Water to make | 1,000 ml (pH at 25° C. 10.00) |
| Bleach-fix Solution: | |
| Water | 400 ml |
| Ammonium Thiosulfate (70 wt % aqueous solution) | 150 ml |
| Sodium Sulfite | 18 g |
| Ammonium Ethylenediaminetetraacetatoferrate (III) | 55 g |
| Disodium Ethylenediaminetetraacetate | 5 g |
| Water to make | 1,000 ml (pH at 25° C. 6.70) |

After washing with water, the samples 1 to 11 each was divided into five equal parts, and the resulting parts were dipped in the following 5 kinds of washing baths, respectively, at 33° C. for 1 minute. At the conclusion of drying, density measurements were carried out. Thereafter, each sample was allowed to stand for 30 days under the condition of 60° C./70% RH. The thus-caused changes in photographic characteristics (i.e., change in minimum density of yellow dye images ($D_B$min) and change in density of cyan dye images at D=2.0 ($D_R$2.0)) are shown in Table 1.

| Washing Bath | | | |
|---|---|---|---|
| A: | Water alone (pH 7.0) | | |
| B: | $NH_4[EDTAFe(III)].2H_2O$ | $1 \times 10^{-5}$ mol/l | (pH 7.0) |
| C: | $NH_4[EDTAFe(III)].2H_2O$ | $5 \times 10^{-4}$ mol/l | (pH 7.0) |
| D: | $NH_4[EDTAFe(III)].2H_2O$ | $1 \times 10^{-3}$ mol/l | (pH 7.0) |
| E: | $NH_4[EDTAFe(III)].2H_2O$ | $1 \times 10^{-3}$ mol/l | |
| | 1-Hydroxyethylidene-1,1-diphosphonic acid | $2 \times 10^{-3}$ mol/l | (pH adjusted to 7.0 with aqueous ammonia) |

As can be seen from the results shown in Table 1, occurrence of yellow stain was effectively prevented and discoloration of cyan dye image was markedly lessened by subjecting the silver halide photosensitive materials containing the magenta couplers of the present invention to the photographic processing of the present invention.

TABLE 1

| Sample No. | Magenta coupler | Remark | Final Bath A (Comparison) | | Final Bath B (Comparison) | | Final Bath C (Invention) | | Final Bath D (Invention) | | Final Bath E (Invention) | |
|---|---|---|---|---|---|---|---|---|---|---|---|---|
| | | | $\Delta D_B$ min | $\Delta D_R$ 2.0 | $\Delta D_b$ min | $\Delta D_R$ 2.0 | $\Delta D_B$ min | $\Delta D_R$ 2.0 | $\Delta D_B$ min | $\Delta D_R$ 2.0 | $\Delta D_B$ min | $\Delta D_R$ 2.0 |
| 1 | (a) | Comparison | +0.24 | −0.25 | +0.29 | −0.23 | +0.32 | −0.12 | +0.38 | −0.10 | +0.33 | −0.11 |
| 2 | (b) | Comparison | +0.20 | −0.25 | +0.25 | −0.22 | +0.30 | −0.11 | +0.36 | −0.10 | +0.32 | −0.12 |
| 3 | (c) | Comparison | +0.25 | −0.24 | +0.30 | −0.22 | +0.33 | −0.11 | +0.39 | −0.11 | +0.33 | −0.11 |
| 4 | (d) | Comparison | +0.23 | −0.24 | +0.29 | −0.23 | +0.34 | −0.10 | +0.40 | −0.10 | +0.34 | −0.11 |
| 5 | (e) | Comparison | +0.23 | −0.25 | +0.28 | −0.23 | +0.33 | −0.12 | +0.39 | −0.10 | +0.34 | −0.12 |
| 6 | (f) | Comparison | +0.30 | −0.25 | +0.34 | −0.23 | +0.36 | −0.11 | +0.41 | −0.11 | +0.37 | −0.12 |
| 7 | (M-6) | Invention | +0.08 | −0.24 | +0.08 | −0.23 | +0.09 | −0.11 | +0.09 | −0.09 | +0.08 | −0.11 |
| 8 | (M-15) | Invention | +0.06 | −0.25 | +0.06 | −0.24 | +0.07 | −0.12 | +0.07 | −0.10 | +0.06 | −0.12 |
| 9 | (M-16) | Invention | +0.08 | −0.25 | +0.08 | −0.23 | +0.09 | −0.12 | +0.09 | −0.11 | +0.08 | −0.11 |
| 10 | (M-26) | Invention | +0.06 | −0.25 | +0.06 | −0.23 | +0.06 | −0.11 | +0.06 | −0.09 | +0.06 | −0.10 |
| 11 | (M-27) | Invention | +0.06 | −0.24 | +0.06 | −0.22 | +0.07 | −0.12 | +0.07 | −0.10 | +0.06 | −0.11 |

Magenta Coupler (a)

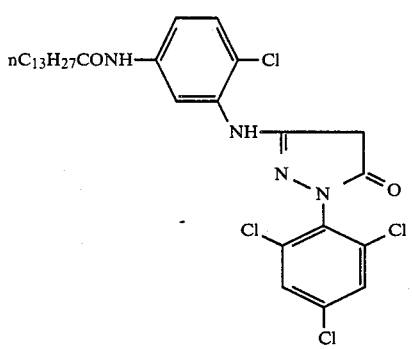

(b)

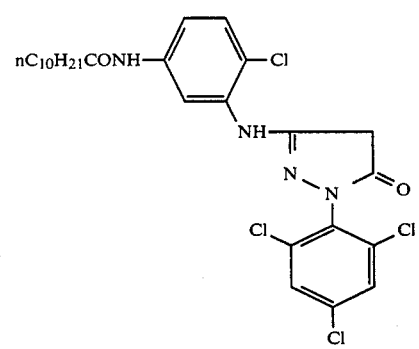

(c)

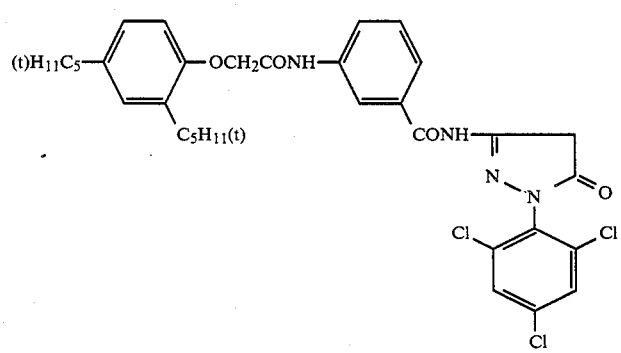

-continued

Magenta Coupler (d)

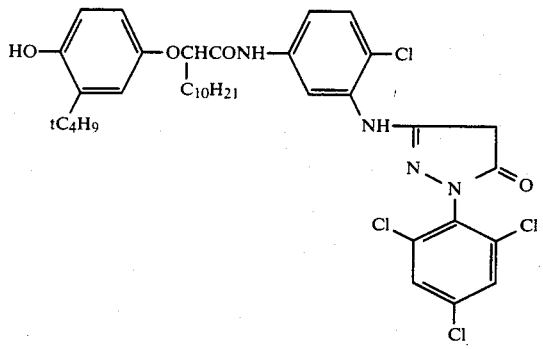

(e)

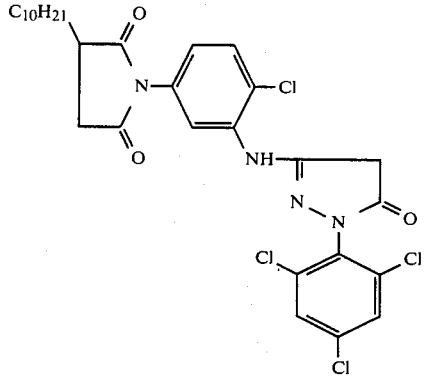

(f)

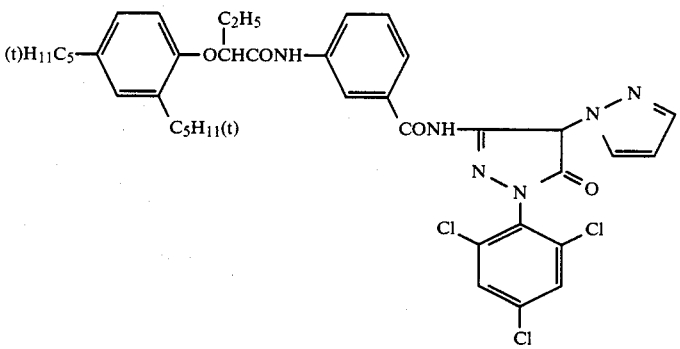

In the cases where magenta couplers (a), (b), (c), (d) and (e) were used respectively, the silver content of the green-sensitive emulsion layer was changed to 0.34 g/m$^2$.

EXAMPLE 2

Samples 12 to 17 were prepared in the same manner as in Example 1 except that cyan couplers and magenta couplers set forth in Table 2 were employed.

TABLE 2

| Sample No. | Cyan Coupler | | Magenta Coupler | |
|---|---|---|---|---|
| 12 | C-1 | 0.50 g/m$^2$ | (a) | 0.40 g/m$^2$ |
| 13 | C-2<br>C-3 | 0.25 g/m$^2$<br>0.32 g/m$^2$ | (a) | 0.40 g/m$^2$ |
| 14 | C-1<br>C-3 | 0.25 g/m$^2$<br>0.32 g/m$^2$ | (a) | 0.40 g/m$^2$ |
| 15 | C-1 | 0.50 g/m$^2$ | M-27 | 0.40 g/m$^2$ |
| 16 | C-2<br>C-3 | 0.25 g/m$^2$<br>0.32 g/m$^2$ | M-27 | 0.40 g/m$^2$ |
| 17 | C-1<br>C-3 | 0.25 g/m$^2$<br>0.32 g/m$^2$ | M-27 | 0.40 g/m$^2$ |

(C-1)

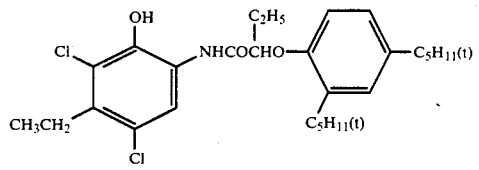

(C-2)

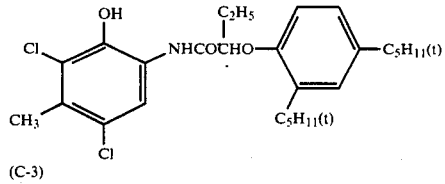

(C-3)

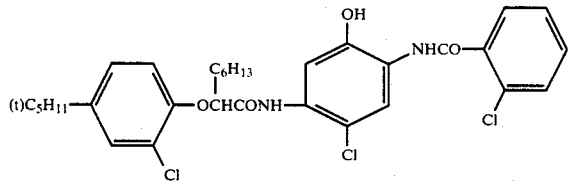

Each of the above-described samples 12 to 17 was exposed imagewise and then, subjected to the continuous processing illustrated below using a Fuji Color Roll Processor FPRP 115 (made by Fuji Photo Film Co., Ltd.).

| Processing Step | Time | Temperature | Tank Volume |
|---|---|---|---|
| Color Development | 3' 30" | 38° C. ± 0.3° C. | 60 l |
| Bleach-fix | 1' 30" | 33° C. ± 1° C. | 40 l |
| Water Washing (1) | 1' 00" | 33° C. ± 3° C. | 20 l |
| Water Washing (2) | 1' 00" | 33° C. ± 3° C. | 20 l |
| Water Washing (3) | 1' 00" | 33° C. ± 3° C. | 20 l |

The washing step employed was the 3-stage counter current washing from the step of Water Washing (3) to the step of Water Washing (1).

In the processing from the bleach-fix step to the water washing step (3), an amount of the processing solution carried from each pretank was controlled to 60 ml/m$^2$.

Conditions of the color development step were maintained constant throughout the step, and the amount of the replenisher used was 161 ml per square meter of the photosensitive material processed. The processing solutions used had the following formulae, respectively.

| Color Developing Solution | Solution in Tank | Replenisher |
|---|---|---|
| Water | 800 ml | 800 ml |
| Trisodium Nitrilotriacetate | 2.0 g | 2.0 g |
| Benzyl Alcohol | 14 ml | 18 ml |
| Diethylene Glycol | 10 ml | 10 ml |
| Sodium Sulfite | 2.0 g | 2.5 g |
| Hydroxylamine Sulfate | 3.0 g | 3.5 g |
| Potassium Bromide | 1.0 g | — |
| Sodium Carbonate | 30 g | 35 g |
| N—Ethyl-N—(β-methanesulfonamidoethyl) -3-methyl-4-aminoaniline Sulfate | 5.0 g | 8.0 g |
| Water to make | 1,000 ml | 1,000 ml |
| pH | 10.15 | 10.65 |

Conditions of the bleach-fix step was maintained constant throughout the step, and the amount of the replenisher used was 60 ml per square meter of the photosensitive material processed. The solutions used had the following formulae, respectively.

| Bleach-fix Bath | Solution in Tank | Replenisher |
|---|---|---|
| Water | 400 ml | 400 ml |
| Ammonium Thiosulfate (70% aqueous soln.) | 150 ml | 300 ml |
| Sodium Sulfite | 18 g | 36 g |
| Ammonium Ethylenediaminetetraacetato-ferrate (III) | 55 g | 110 g |
| Disodium Ethylenediaminetetraacetate | 5 g | 10 g |
| Water to make | 1,000 ml | 1,000 ml |
| pH | 6.70 | 6.50 |

Each photosensitive material underwent the washing step under the following four kinds of conditions.

Condition F: Water alone was replenished in an amount of 10 liter per square meter of photosensitive material processed.

Condition G: Water alone was replenished in an amount of 1,000 ml per square meter of photosensitive material processed.

Condition H: Water alone was replenished in an amount of 250 ml per square meter of photosensitive material processed.

Condition I: The replenisher having the following formula was supplemented in an amount of 250 ml per square meter of photosensitive material processed.

| Replenisher | |
|---|---|
| 1-Hydroxyethylidene-1,1-diphosphonic Acid (60% aqueous solution) | 2.0 ml |
| Ammonium Alum | 1.0 g |
| 2-(4-Thiazolyl)benzimidazole | 30 mg |
| Water to make | 1 l |
| pH adjusted with aqueous ammonia | 7.0 |

An area of 400 m$^2$ of each photosensitive material was processed under all of the four conditions described above. At this stage, density measurements of the photosensitive materials which had received wedgewise exposure and the photographic processing described above were carried out. Thereafter, each photosensitive material was allowed to stand for 60 days under condition of 60° C./70% RH. The thus caused changes in photographic characteristics (i.e., change in minimum density of yellow dye images and change in density of cyan dye images at D=2.0) were measured.

In addition, the iron concentration in the final bath at this stage was determined using an atomic absorption analysis.

The results obtained are shown in Table 3 below.

TABLE 3

| Sample | | Washing Condition E Iron Concentration (1.3-1.5) × 10$^{-7}$ mol (Comparison) | | Washing Condition F Iron Concentration (1.5-1.6) × 10$^{-5}$ mol (Comparison) | | Washing Condition G Iron Concentration (6.0-6.5) × 10$^{-3}$ mol (Invention) | | Washing Condition H Iron Concentration (6.0-6.5) × 10$^{-3}$ mol (Invention) | |
|---|---|---|---|---|---|---|---|---|---|
| No. | Remark | $\Delta D_B$ min | $\Delta D_R$ 2.0 | $\Delta D_B$ min | $\Delta D_R$ 2.0 | $\Delta D_B$ min | $\Delta D_R$ 2.0 | $\Delta D_B$ min | $\Delta D_R$ 2.0 |
| 12 | Comparison | +0.36 | −0.33 | +0.43 | −0.32 | +0.47 | −0.15 | +0.44 | −0.16 |
| 13 | Comparison | +0.35 | −0.32 | +0.40 | −0.30 | +0.45 | −0.13 | +0.40 | −0.14 |
| 14 | Comparison | +0.36 | −0.24 | +0.42 | −0.22 | +0.46 | −0.11 | +0.42 | −0.12 |
| 15 | Invention | +0.17 | −0.32 | +0.17 | −0.31 | +0.18 | −0.15 | +0.17 | −0.16 |
| 16 | Invention | +0.16 | −0.32 | +0.16 | −0.30 | +0.17 | −0.12 | +0.16 | −0.13 |
| 17 | Invention | +0.17 | −0.24 | +0.17 | −0.22 | +0.18 | −0.10 | +0.17 | −0.11 |

As can be clearly seen from the results of Table 3, not only discoloration of cyan dye images and increase in yellow stain are prevented, but also the amount of washing water can be sharply reduced.

While the invention has been described in detail and with reference to specific examples thereof, it will be apparent to one skilled in the art that various changes and modifications can be made therein without departing from the spirit and scope thereof.

What is claimed is:

1. A method for processing a silver halide color photographic material, which comprises processing a photographic material containing at least one pyraoloazole type magenta coupler represented by the following general formula (I) in a final bath containing a soluble iron salt in an amount of at least $1\times10^{-4}$ mol/l:

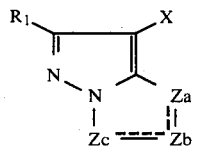

(I)

wherein $R_1$ represents a hydrogen atom or a substituent, X represents a hydrogen atom or a group capable of being eliminated by the coupling reaction with an oxidation product of an aromatic primary amine developing agent, and $Z_a$, $Z_b$ and $Z_c$ each represents methine group, a substituted methine group, =N— or —NH—, provided that one of the $Z_a$–$Z_b$ and the $Z_b$–$Z_c$ bonds is a double bond and the other is a single bond, in which when it represents a double bond, the $Z_b$–$Z_c$ bond includes one which constitutes a part of an aromatic ring, and further, the substituent $R_1$ or X, or the substituted methine represented by $Z_a$, $Z_b$ or $Z_c$ may form a polymer including a dimer.

2. The method as claimed in claim 1, wherein said compound represented by formula (I) is a compound represented by general formulae (II), (III), (IV), (V), (VI) and (VII),

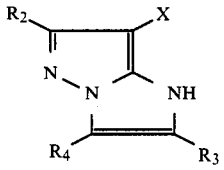

(II)

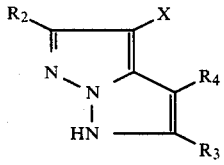

(III)

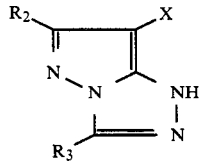

(IV)

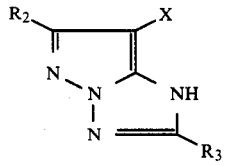

(V)

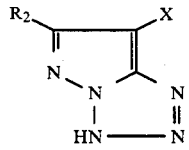

(VI)

-continued

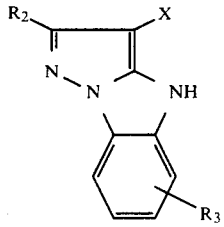

(VII)

wherein $R_2$, $R_3$ and $R_4$ represent hydrogen atom, a halogen atom, an alkyl group, an aryl group, a heterocyclic group, a cyano group, an alkoxy group, an aryloxy group, a heterocyclicoxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclicthio group, an alkoxycarbonylamino group, an alyloxycarbonylamino group, a sulfonamido group, a carbamoyl group, an acyl group, a sulfamoyl group, a sulfonyl group, an alkoxycarbonyl group or an aryloxycarbonyl group, and X represents hydrogen atom, a halogen atom, a carboxy group or a group which is attached, through oxygen atom, nitrogen atom or sulfur atom contained therein, to the carbon atom situated in the coupling position and can be eliminated from the compound upon a coupling reaction.

3. The method as claimed in claim 2, wherein said compound represented by formula (I) is a compound represented by general formula (II) and (V).

4. The method as claimed in claim 2, wherein $R_2$, $R_3$ and $R_4$ or X is a divalent group which forms a bis compound.

5. The method as claimed in claim 2, wherein the moiety represented by the general formula (II) to (VII) is a vinyl monomer, $R_2$, $R_3$ or $R_4$ represents a chemical bond or linkage group through which the moiety represented by the general formula (II) to (VII) and the vinyl group are linked.

6. The method as claimed in claim 1, wherein the said magenta coupler is employed in an amount of from $2\times10^{-3}$ to $5\times10^{-1}$ mol per mol of silver contained in an emulsion layer.

7. The method as claimed in claim 6, wherein the said magenta coupler is employed in an amount of from $1\times10^{-2}$ to $5\times10^{-1}$ mol per mol of silver contained in an emulsion layer.

8. The method as claimed in claim 1, wherein said soluble iron salt is employed in an amount of from $1\times10^{-4}$ to $1\times10^{-1}$ mol per liter.

9. The method as claimed in claim 8, wherein said soluble iron salt is employed in an amount of from $2\times10^{-4}$ to $1\times10^{-2}$ mol per liter.

10. The method as claimed in claim 1, wherein said final bath is a washing bath of the multistage counter current type.

11. The method as claimed in claim 1, wherein said final bath is a stabilizing bath and wherein the pre-bath thereof is a washing bath having outlets in one tank or a stabilizing bath of the multistage counter current type without a washing process.

12. The method as claimed in claim 1, wherein said soluble iron salt is the iron salt which can be complexed substantially with a chelating agent in the bath.

13. The method as claimed in claim 12, wherein said chelating agent is one selected from the group consisting of
$Na_4P_4O_{12}$, F-1
$Na_6P_4O_{13}$, F-2
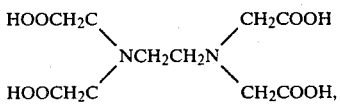
F-3
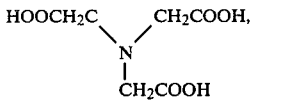
F-4
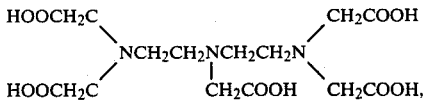
F-5
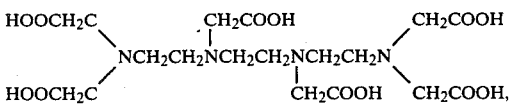
F-6
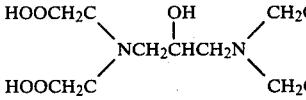
F-7
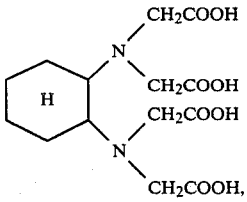
F-8
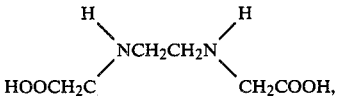
F-9
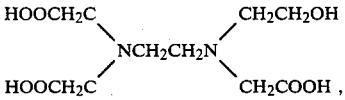
F-10
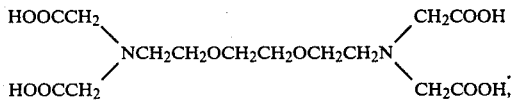
F-11
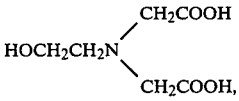
F-12
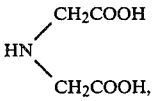
F-13
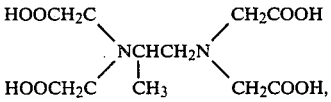
F-14
-continued
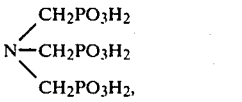
F-15
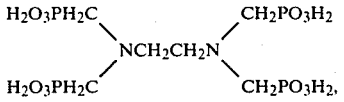
F-16
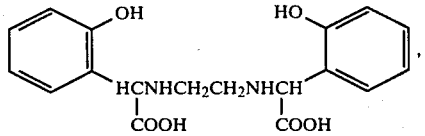
F-17
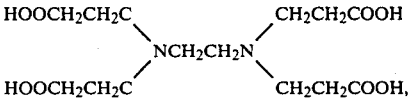
F-18
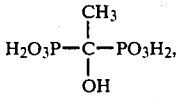
F-19
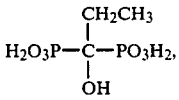
F-20
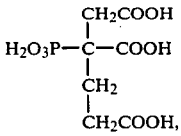
F-21
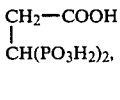
F-22
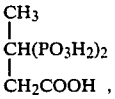
F-23
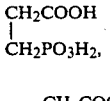
F-24
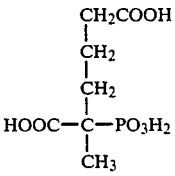
F-25
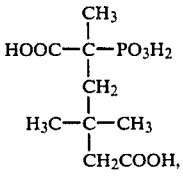
F-26

-continued

F-27

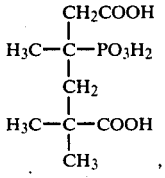

F-28

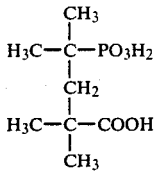

F-29

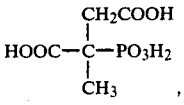

F-30

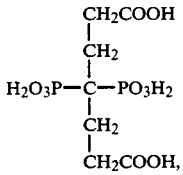

-continued

F-31

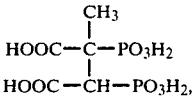

F-32

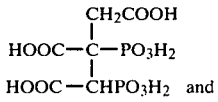

and

F-33

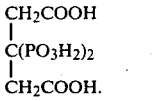

14. The method as claimed in claim 1, wherein $R_1$ is selected from the group consisting of a hydrogen atom, a halogen atom, an alkyl group, an aryl group, a heterocyclic group, a cyano group, an alkoxy group, an aryloxy group, a heterocyclicoxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclicthio group, an alkoxycarbonylamino group, an alyloxycarbonylamino group, a sulfonamindo group, a carbamoyl group, an acyl group, a sulfamoyl group, a sulfonyl group, an alkoxycarbonyl group or an aryloxycarbonyl group.

* * * * *